US010538879B2

(12) United States Patent
Baker et al.

(10) Patent No.: US 10,538,879 B2
(45) Date of Patent: Jan. 21, 2020

(54) DISPERSIBLE MOIST WIPE AND METHOD OF MAKING

(71) Applicant: KIMBERLY-CLARK WORLDWIDE, INC., Neenah, WI (US)

(72) Inventors: Joseph K. Baker, Neenah, WI (US); David A. Moline, Neenah, WI (US); Colin Ackroyd, Neenah, WI (US); Lynn P. Bresnahan, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 11 days.

(21) Appl. No.: 15/579,655

(22) PCT Filed: Jun. 29, 2015

(86) PCT No.: PCT/US2015/038281
§ 371 (c)(1),
(2) Date: Dec. 5, 2017

(87) PCT Pub. No.: WO2017/003426
PCT Pub. Date: Jan. 5, 2017

(65) Prior Publication Data

US 2018/0171558 A1 Jun. 21, 2018

(51) Int. Cl.

| | |
|---|---|
| ***D21H 11/14*** | (2006.01) |
| ***D04H 1/425*** | (2012.01) |
| ***D04H 1/4258*** | (2012.01) |
| ***D04H 1/492*** | (2012.01) |
| ***A47K 7/02*** | (2006.01) |
| ***D04H 1/72*** | (2012.01) |
| ***D21H 27/00*** | (2006.01) |

(52) U.S. Cl.
CPC ..... *D21H 11/14* (2013.01); *A47K 7/02* (2013.01); *D04H 1/425* (2013.01); *D04H 1/4258* (2013.01); *D04H 1/492* (2013.01); *D04H 1/72* (2013.01); *D21H 27/005* (2013.01); *D10B 2401/024* (2013.01); *D10B 2401/06* (2013.01); *D10B 2509/00* (2013.01)

(58) Field of Classification Search
USPC ..... 162/147
See application file for complete search history.

(56) References Cited

U.S. PATENT DOCUMENTS

| | | | |
|---|---|---|---|
| 4,755,421 | A | 7/1988 | Manning et al. |
| 6,287,419 | B1 | 9/2001 | Takeuchi et al. |
| 6,602,386 | B1 | 8/2003 | Takeuchi et al. |
| 6,670,521 | B2 | 12/2003 | Noda et al. |
| 6,749,718 | B2 | 6/2004 | Takai et al. |
| 7,241,711 | B2 | 7/2007 | Takai et al. |
| 7,250,382 | B2 | 7/2007 | Takai et al. |
| 7,732,357 | B2 | 6/2010 | Annis et al. |
| 8,216,425 | B2 | 7/2012 | Sumnicht et al. |
| 8,668,808 | B2 | 3/2014 | Strandqvist |
| 8,673,116 | B2 | 3/2014 | Konishi et al. |
| 9,005,395 | B1 | 4/2015 | Zwick et al. |
| 2003/0000665 | A1 | 1/2003 | Takai et al. |
| 2008/0076313 | A1 | 3/2008 | Uitenbroek et al. |
| 2012/0080155 | A1 | 4/2012 | Konishi et al. |
| 2014/0189970 | A1 | 7/2014 | Fingal et al. |
| 2014/0318726 | A1 | 10/2014 | Collins et al. |

FOREIGN PATENT DOCUMENTS

| | | | |
|---|---|---|---|
| EP | 2441869 | A1 | 4/2012 |
| EP | 2001663 | B1 | 3/2013 |
| JP | 3284960 | B2 | 5/2002 |
| JP | 3948071 | B2 | 7/2007 |
| WO | 2014092806 | A1 | 6/2014 |

OTHER PUBLICATIONS

International Search Report and Written Opinion for Application No. PCT/US2015/038281, dated Mar. 24, 2016, 14 pages.
Written Opinion of IPEA for Application No. PCT/US2015/038281, dated Nov. 21, 2017, 3 pages.
EP Extended Search Report for related application 15897312.3 dated Feb. 28, 2019; 7 pp.

*Primary Examiner* — Mark Halpern
(74) *Attorney, Agent, or Firm* — Armstrong Teasdale LLP

(57) ABSTRACT

A dispersible moist wipe includes regenerated cellulose fibers in an amount equal to or less than 20 percent by weight and natural cellulose fibers in an amount equal to or greater than 80 percent by weight. At least 50 percent of the natural cellulose fibers are fibrillated. The regenerated cellulose fibers and the natural cellulose fibers are hydroentangled such that the web has a wet CD tensile strength of at least 200 grams per inch. A method of making a dispersible nonwoven sheet includes dispersing natural cellulose fibers and regenerated cellulose fibers in a liquid medium to form a liquid suspension and depositing the liquid suspension over a forming surface to form a nonwoven web. The natural cellulose fibers and regenerated cellulose fibers of the web are hydroentangled using a plurality of hydroentangling jets.

11 Claims, 7 Drawing Sheets

DISPERSIBLE MOIST WIPE AND METHOD OF MAKING

FIELD

The field of the invention relates generally to moist wipes and more specifically to dispersible moist wipes adapted to be flushed down a toilet and methods of making such moist wipes.

BACKGROUND

Dispersible moist wipes are generally intended to be used and then flushed down a toilet. Accordingly, it is desirable for such flushable moist wipes to have an in-use strength sufficient to withstand a user's extraction of the wipe from a dispenser and the user's wiping activity, but then relatively quickly lose strength in household and municipal sanitization systems, such as sewer or septic systems. Flushable moist wipes must be compatible with home plumbing fixtures and drain lines, as well with onsite and municipal wastewater treatment systems.

One challenge for some known flushable moist wipes is that it takes a relatively long time for them to lose strength in a sanitation system as compared to conventional, dry toilet tissue thereby creating a risk of decreased compatibility with wastewater conveyance and treatment systems. Dry toilet tissue typically exhibits lower post-use strength fairly quickly upon exposure to tap water, whereas some flushable moist wipes may require a relatively long period of time and/or significant agitation within tap water for their post-use strength to decrease sufficiently to allow them to disperse. Attempts to address this issue (i.e., attempts to make the wipes lose strength more quickly in tap water) often reduce the in-use strength of the flushable moist wipes below a minimum level deemed acceptable by users.

Some known flushable moist wipes are formed, at least in part, by entangling fibers in a nonwoven web. A nonwoven web is a structure of individual fibers that are interlaid to form a matrix, but not in an identifiable repeating manner. While the entangled fibers themselves may disperse relatively quickly, some known wipes require additional structure to improve in-use strength. For example, some known wipes use a net having fibers entangled therewith. The net provides additional cohesion to the entangled fibers for increased in-use strength. However, such nets do not optimally disperse.

Some known moist wipes obtain increased in-use strength by entangling bi-component fibers in the nonwoven web. After entanglement, the bi-component fibers are thermoplastically bonded together to increase in-use strength. However, the thermoplastically bonded fibers may negatively impact the ability of the moist wipe to loss strength in a sanitization system (e.g., tap water) in a timely fashion. That is, the bi-component fibers and thus the moist wipe containing the bi-component fibers may not readily loss strength when flushed down a toilet.

Other known flushable moist wipes add a triggerable salt-sensitive binder. The binder attaches to the cellulose fibers of the wipes in a formulation containing a salt solution, yielding a relatively high in-use strength. When the used moist wipes are exposed to the water of the toilet and/or sewer system, the binder swells thereby allowing and potentially even assisting in the wipes falling apart, which allows for relatively rapid strength loss of the wipes. However, such binders are relatively costly.

Still other known flushable moist wipes incorporate a relatively high quantity of regenerated natural fibers and/or synthetic fibers to increase the in-use strength. However, the ability of such wipes to disperse in a timely fashion is correspondingly reduced. In addition, the higher cost of regenerated natural fibers and synthetic fibers relative to natural fibers causes a corresponding increase in cost of such known moist wipes.

Thus, there is a need to provide a wet wipe made from a dispersible nonwoven web (and a method of making such a web) that provides an in-use strength (e.g., wet CD tensile strength, wet MD tensile strength, burst strength) expected by consumers, loses strength sufficiently quickly, and is cost-effective to produce.

BRIEF DESCRIPTION

In one aspect, a dispersible moist wipe generally comprises regenerated cellulose fibers in an amount equal to or less than 20 percent by weight and natural cellulose fibers in an amount equal to or greater than 80 percent by weight. At least 50 percent of the natural cellulose fibers are fibrillated. The regenerated cellulose fibers and the natural cellulose fibers are hydroentangled such that the web has a wet CD tensile strength of at least 200 grams per inch.

In another aspect, a dispersible moist wipe generally comprises synthetic fibers between 0 and 10 percent by weight, regenerated cellulose fibers between 5 percent and 20 percent by weight, and natural cellulose fibers in an amount between 70 and 95 percent by weight. At least 50 percent of the natural cellulose fibers are fibrillated. The regenerated cellulose fibers and the natural cellulose fibers are hydroentangled such that the web has a wet CD tensile strength of at least 200 grams per inch.

In yet another aspect, a method for making a dispersible nonwoven sheet generally comprises dispersing natural cellulose fibers and regenerated cellulose fibers in a ratio of about 80 to about 95 percent by weight natural cellulose fibers and about 5 to about 20 percent by weight regenerated cellulose fibers in a liquid medium to form a liquid suspension. At least 50 percent of the natural cellulose fibers are fibrillated. The liquid suspension is deposited over a forming surface to form a nonwoven web. The natural cellulose fibers and regenerated cellulose fibers of the nonwoven web are hydroentangled using a plurality of hydroentangling jets. The pressure imparted by each of the jets on the nonwoven web is between about 20 bars and about 80 bars. The nonwoven web is dried to form the dispersible nonwoven sheet.

DETAILED DESCRIPTION OF THE DRAWINGS

The dispersible moist wipes of the current disclosure have sufficient strength to withstand packaging and consumer use. They also lose strength sufficiently quickly. Additionally, they can be made of materials and a method of manufacture that are cost-effective.

Figure 1:
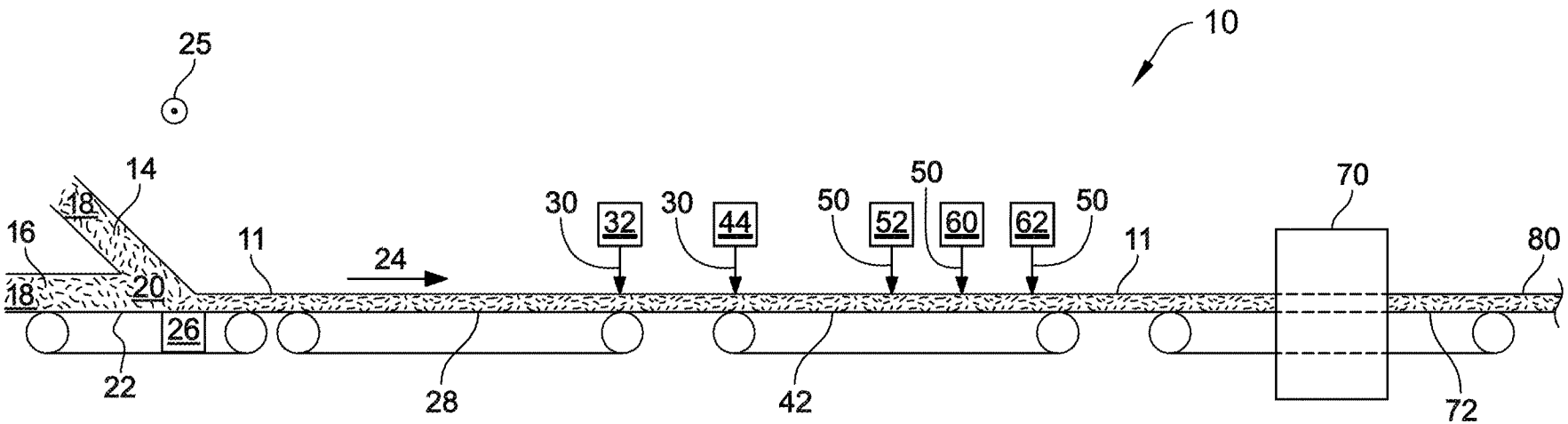
FIG. 1 is a schematic of one suitable embodiment of an apparatus for making dispersible moist wipes.

One suitable embodiment of an apparatus, indicated generally at 10, for making a dispersible nonwoven sheet 80 comprising one or more dispersible moist wipes is shown in FIG. 1. It is contemplated that the sheet 80 can comprise a continuous web of interconnected dispersible moist wipe or a single dispersible moist wipe of a plurality of discrete moist wipes being made by the apparatus 10. The apparatus 10 is configured to form a nonwoven fibrous web 11 comprising a mixture of natural cellulose fibers 14 and regenerated cellulose fibers 16. The natural cellulose fibers 14 are cellulosic fibers derived from woody or non-woody plants including, but not limited to, southern softwood kraft, northern softwood kraft, softwood sulfite pulp, cotton, cotton linters, bamboo, and the like. In some embodiments, the natural fibers 14 have a length-weighted average fiber length greater than about 1 millimeter. Furthermore, the natural fibers 14 may have a length-weighted average fiber length greater than about 2 millimeters. In other suitable embodiments, the natural fibers 14 are short fibers having a fiber length between about 0.5 millimeters and about 1.5 millimeters.

At least some of the natural cellulose fibers 14 are fibrillated. In one suitable embodiment, at least 50 percent by weight of the natural cellulose fibers 14 are fibrillated. In one preferred embodiment, all of the natural cellulose fibers 14 are fibrillated. That is, in one preferred embodiment, 100 percent by weight of the natural cellulose fibers 14 are fibrillated. Thus, it is contemplated that the percentage of natural cellulose fibers 14 by weight that is fibrillated can be anywhere between 50 and 100.

Fibrillation of the natural cellulose fibers 14 results in segments (or portions) of the fiber's outer surface to be partially detach from the main fiber structure and become fibrils. The fibrils are typically attached at one end to the main fiber structure and extend outward from the main fiber structure to a free end. As can be readily appreciated and described in more detail below, the fibrils provide additional fiber structure to engage and otherwise bond (e.g., entanglement, hydrogen bonding) to other fibers (including other fibrils) in sheet 80.

Fibrillation of the natural cellulose fibers 14 can be done using any suitable technique known in the art. Thus, the natural cellulose fibers 14 can be fibrillated using mechanical agitation, chemical treatment, or combinations thereof. In one suitable embodiment, for example, fibrillation of the natural cellulose fibers 14 can be done using a refiner, which mechanically agitates the fibers. It is noted, that preservation of the length of the natural cellulose fibers 14 should be preserved during the fibrillation process. Accordingly, the natural cellulose fibers 14 should retain their length during the fibrillation process such that following fibrillation the length of the fibers are substantially the same as before fibrillation.

The regenerated fibers 16 are man-made filaments obtained by extruding or otherwise treating regenerated or modified cellulosic materials from woody or non-woody plants, as is known in the art. For example, but not by way of limitation, the regenerated fibers 16 may include one or more of lyocell, rayon, and the like. In some embodiments, the regenerated fibers 16 have a fiber length in the range of about 3 to about 20 millimeters. Furthermore, the regenerated fibers 16 may have a fiber length in the range of about 6 to about 12 millimeters. Additionally, in some embodiments, the regenerated fibers 16 may have a decitex in the range of about 0.7 g/10,000 m to about 2 g/10,000 m. Moreover, the decitex may be in the range of about 0.9 g/10,000 m to about 1.1 g/10,000 m. In one suitable embodiment, the regenerated fibers 16 are not mechanically treated to alter or otherwise affect the shape the fiber. More specifically, the regenerated fibers 16 are not fibrillated.

In some other suitable embodiments, it is contemplated to use synthetic fibers in combination with, or as a substitute for, the regenerated fibers 16. For example, but not by way of limitation, the synthetic fibers may include one or more of nylon, polyethylene terephthalate (PET), and the like. In some embodiments, the synthetic fibers have a fiber length in the range of about 3 to about 20 millimeters. Furthermore, the synthetic fibers may have a fiber length in the range of about 6 to about 12 millimeters. In one suitable embodiment, the synthetic fibers are not mechanically treated to alter or otherwise affect the shape the fiber. More specifically, the synthetic fibers are not fibrillated.

In making the nonwoven sheet 80, as illustrated in FIG. 1, the natural fibers 14 and regenerated fibers 16 are dispersed in a liquid suspension 20 to a headbox 12. A liquid medium 18 used to form the liquid suspension 20 may be any liquid medium known in the art that is compatible with the process as described herein, for example, water. In some embodiments, a consistency of the liquid suspension 20 is in the range of about 0.02 to about 0.08 percent fiber by weight. Moreover, the consistency of the liquid suspension 20 may be in the range of about 0.03 to about 0.05 percent fiber by weight. In one suitable embodiment, the consistency of the liquid suspension 20 after the natural fibers 14 and the regenerated fibers 16 are added is about 0.03 percent fiber by weight. A relatively low consistency of the liquid suspension 20 at the headbox 12 is believed to enhance mixing of the natural fibers 14 and the regenerated fibers 16 and, therefore, enhances a formation quality of the nonwoven web 11.

In one suitable embodiment, of the total weight of fibers present in the liquid suspension 20, a ratio of natural fibers 14 and regenerated fibers 16 is about 80 to about 95 percent by weight natural fibers 14 and about 5 to about 20 percent by weight regenerated fibers 16. In another suitable embodiment, of the total weight of fibers present in the liquid suspension 20, the ratio of natural fibers 14 and regenerated fibers 16 is about 90 to about 95 percent by weight natural fibers 14 and about 5 to about 10 percent by weight regenerated fibers 16. In one suitable example, of the total weight of fibers present in the liquid suspension 20, the natural fibers 14 may be 90 percent of the total weight and the regenerated fibers 16 may be 10 percent of the total weight.

In another suitable embodiment, of the total weight of fibers present in the liquid suspension 20, a ratio of synthetic fibers, natural fibers 14, and regenerated fibers 16 is about 0 to about 10 percent by weight synthetic fibers, about 5 to about 20 percent by weight regenerated cellulose fibers, and between about 70 to about 95 percent natural cellulose fibers. In one suitable example, of the total weight of fibers present in the liquid suspension 20, the natural fibers 14 may be 90 percent of the total weight and the regenerated fibers 16 may be 5 percent of the total weight and the synthetic fibers may be 5 percent of the total weight. As mentioned above, it is contemplated that the sheet 80 can be free of synthetic fibers.

Figure 2:
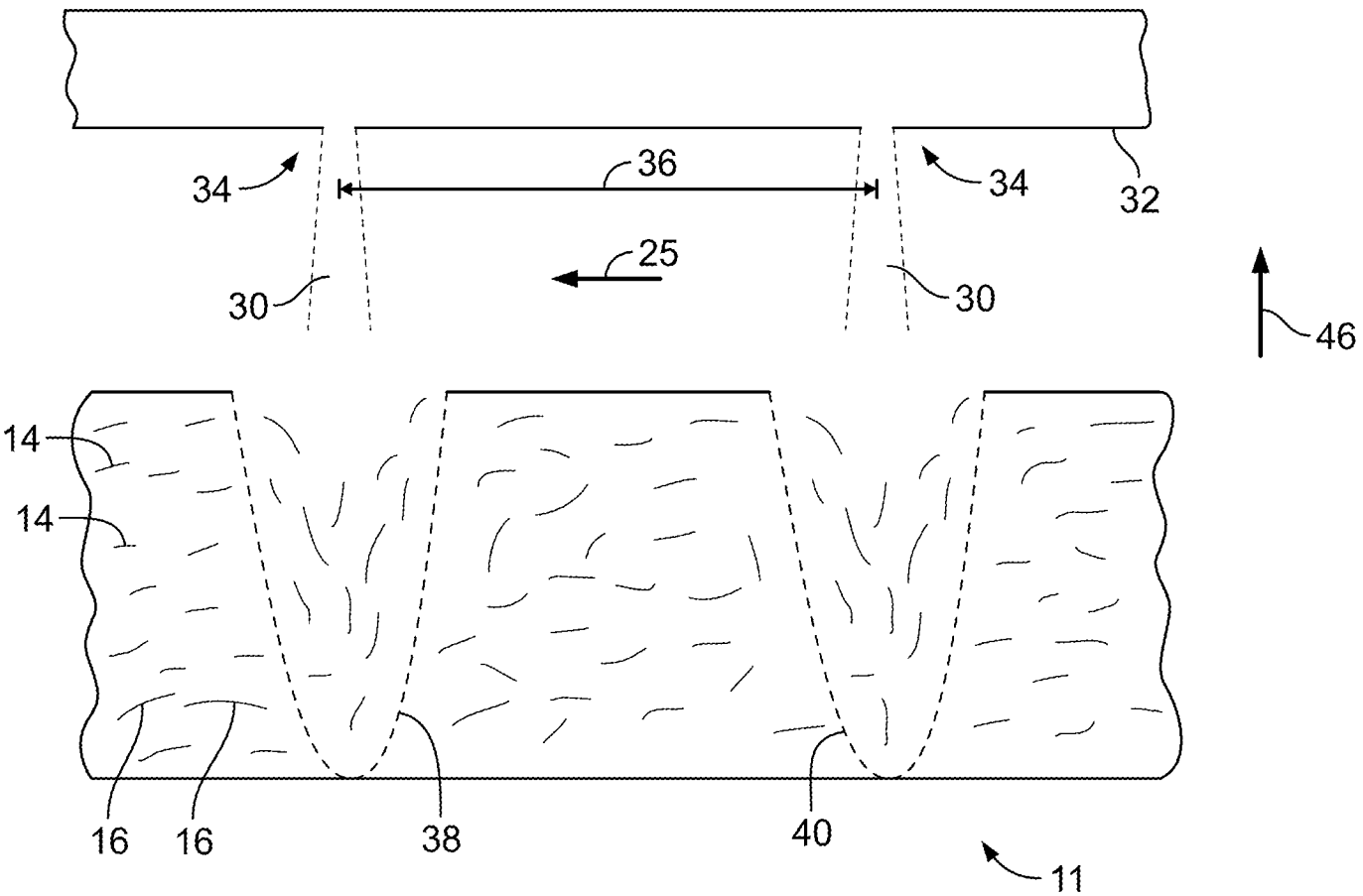
FIG. 2 is a schematic of a nonwoven web at one location within the apparatus of FIG. 1.

The headbox 12 is configured to deposit the liquid suspension 20 onto a foraminous forming wire 22, which retains the fibers to form the nonwoven fibrous web 11. In an embodiment, the headbox 12 is configured to operate in a low-consistency mode as is described in U.S. Pat. No. 7,588,663 issued to Skoog et al. and assigned to Kimberly-Clark Worldwide, Inc., which is herein incorporated by reference. In another suitable embodiment, the headbox 12 is any headbox design that enables forming the nonwoven tissue web 11 such that it has a Formation Number of at least 18. The forming wire 22 carries the web 11 in a direction of travel, which is indicated by arrow 24. A longitudinal axis of the nonwoven tissue web 11 is aligned with the direction of travel 24 and is hereinafter referred to as "machine direction," and a transverse axis, which is perpendicular to the machine direction, is hereinafter referred to as "cross-machine direction", which is indicated by arrow 25 (FIG. 2). In some embodiments, the apparatus 10 is configured to draw a portion of the remaining liquid dispersing medium 18 out of the wet nonwoven tissue web 11 as the web travels along the forming wire 22, such as by the operation of a vacuum box 26.

The apparatus 10 also may be configured to transfer the nonwoven tissue web 11 from the forming wire 22 to a transfer wire 28. In some embodiments, the transfer wire 28 carries the nonwoven web in the machine direction 24 under a first plurality of jets 30. The first plurality of jets 30 may be produced by a first manifold 32 with at least one row of first orifices 34 spaced apart along the cross-machine direction 25 (FIG. 2). The first manifold 32 is configured to supply a liquid, such as water, at a first pressure to the first orifices 34 to produce a columnar jet 30 at each first orifice 34. In some embodiments, the first pressure is in the range of about 20 to about 125 bars. In one suitable embodiment, the first pressure is between about 40 and 60 bars.

In one suitable embodiment, each first orifice 34 is of circular shape with a diameter in the range of about 90 to about 150 micrometers. In one suitable embodiment, for example, each first orifice 34 has a diameter of about 120 micrometers. In addition, each first orifice 34 is spaced apart from an adjacent first orifice 34 by a first distance 36 along the cross-machine direction 25. In some embodiments, the first distance 36 is such that a first region 38 of fibers of the nonwoven tissue web 11 displaced by each jet of the first plurality of jets 30 does not overlap substantially with a second region 40 of fibers displaced by the adjacent one of the first plurality of jets 30, as illustrated schematically in FIG. 2. Instead, the fibers in each of the first region 38 and the second region 40 are substantially displaced in a direction along an axis, which is indicated in FIG. 2 by arrow 46, perpendicular to the plane of nonwoven web 11 (i.e., the z-direction), but are not significantly hydroentangled with laterally adjacent fibers. In some embodiments, the first distance 36 is in the range of about 1200 to about 2400 micrometers. In one suitable embodiment, the first distance 36 is about 1800 micrometers. In other suitable embodiments, the first plurality of jets 30 may be produced by first orifices 34 having any shape, or any jet nozzle and pressurization arrangement, that is configured to produce a row of columnar jets 30 spaced apart along the cross-machine direction 25 in like fashion.

Additional ones of the first plurality of jets 30 optionally may be produced by additional manifolds, such as a second manifold 44 shown in the exemplary embodiment of FIG. 1, spaced apart from the first manifold 32 in the machine direction. A foraminous support fabric 42 is configured such that the nonwoven tissue web 11 may be transferred from the transfer wire 28 to the support fabric 42. In an embodiment, the support fabric 42 carries the nonwoven tissue web 11 in the machine direction 24 under the second manifold 44. It should be understood that the number and placement of transport wires or transport fabrics, such as the forming wire 22, the transport wire 28, and the support fabric 42, may be varied in other embodiments. For example, but not by way of limitation, the first manifold 32 may be located to treat the nonwoven tissue web 11 while it is carried on the support fabric 42, rather than on the transfer wire 28, or conversely the second manifold 44 may be located to treat the nonwoven tissue web 11 while it is carried on the transfer wire 28, rather than on the support fabric 42. In another example, one of the forming wire 22, the transport wire 28, and the support fabric 42 may be combined with another in a single wire or fabric, or any one may be implemented as a series of cooperating wires and transport fabrics rather than as a single wire or transport fabric.

In some embodiments, the second manifold 44, like the first manifold 32, includes at least one row of first orifices 34 spaced apart along the cross-machine direction 25. The second manifold 44 is configured to supply a liquid, such as water, at a second pressure to the first orifices 34 to produce a columnar jet 30 at each first orifice 34. In some embodiments, the second pressure is in the range of about 20 to about 125 bars. In one suitable embodiment, the second pressure is between about 40 and 60 bars. Moreover, in some embodiments, each first orifice 34 is of circular shape, and each first orifice 34 is spaced apart from an adjacent first orifice 34 by a first distance 36 along the cross-machine direction 25, as shown in FIG. 2 for the first manifold 32. In other embodiments, the second manifold 44 may be configured in any other fashion such that a first region of fibers of nonwoven tissue web 11 displaced by each jet of the first plurality of jets 30 does not overlap substantially with a second region of fibers displaced by the adjacent one of the first plurality of jets 30.

With reference again to FIG. 1, the support fabric 42 carries the nonwoven web 11 in the machine direction 24 under a second plurality of jets 50. The second plurality of jets 50 may be produced by a third manifold 52 with at least one row of second orifices 54 spaced apart along the cross-machine direction 25. The third manifold 52 is configured to supply a liquid, such as water, at a third pressure to the second orifices 54 to produce a columnar jet 50 at each third orifice 54. In some embodiments, the third pressure is in the range of about 20 to about 125 bars. In one suitable embodiment, the third pressure may be in the range of about 40 to about 60 bars.

Figure 3:
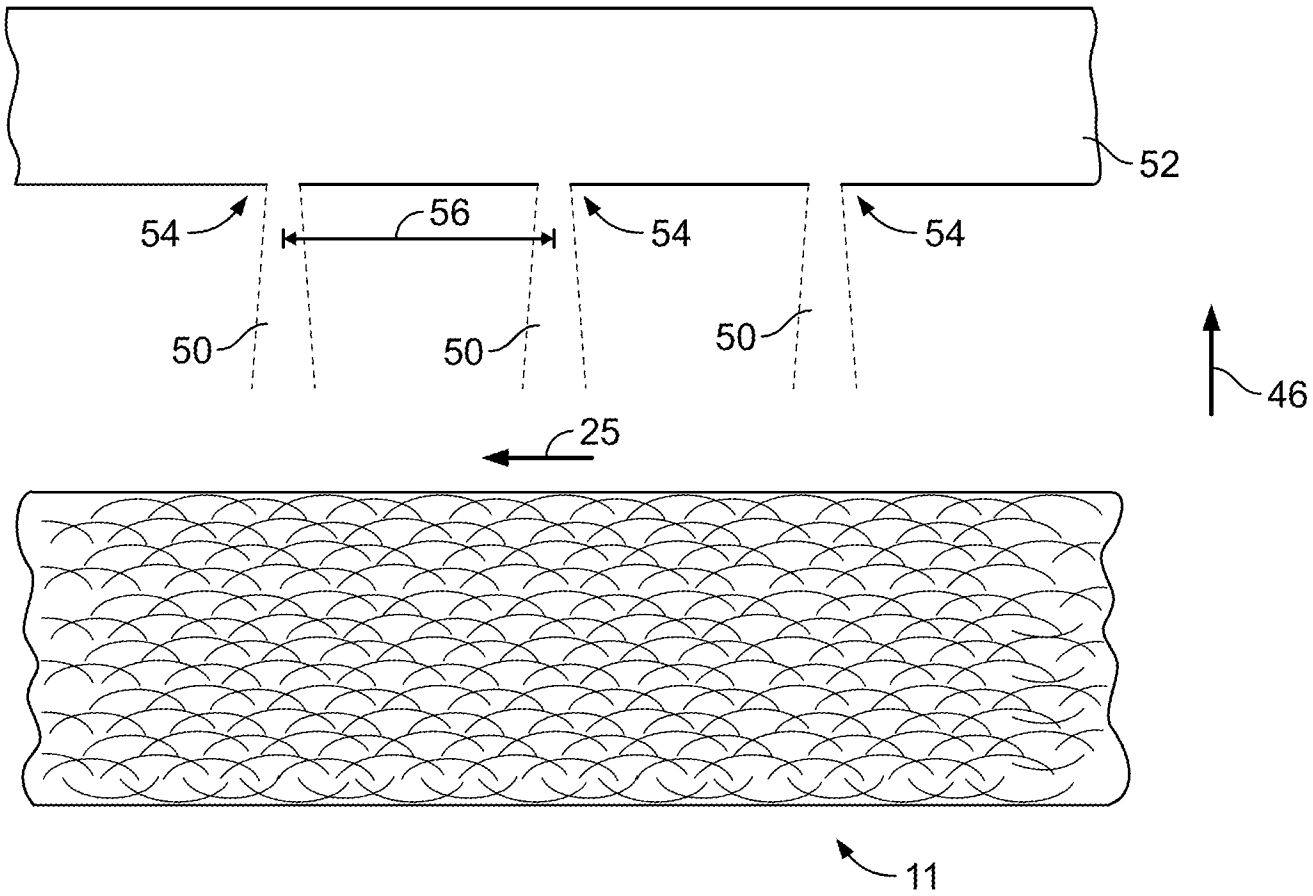
FIG. 3 is a schematic of a nonwoven web at another location within the apparatus of FIG. 1.

In some embodiments, each second orifice 54 is of circular shape with a diameter in the range of about 90 to about 150 micrometers. Moreover, each second orifice 54 may have a diameter of about 120 micrometers. In addition, each second orifice 54 is spaced apart from an adjacent second orifice 54 by a second distance 56 along the cross-machine direction 25, as illustrated in FIG. 3, and the second distance 56 is such that the fibers of the nonwoven tissue web 11 become substantially hydroentangled. In some embodiments, the second distance 56 is in the range of about 400 to about 1000 micrometers. Further, the second distance 56 may be in the range of about 500 to about 700 micrometers. In an embodiment, the second distance 56 is about 600 micrometers. In other suitable embodiments, the second plurality of jets 50 may be produced by second orifices 54 having any shape, or any jet nozzle and pressurization arrangement, that is configured to produce a row of columnar jets 50 spaced apart along the cross-machine direction 25 in like fashion.

Additional ones of the second plurality of jets 50 optionally may be produced by additional manifolds, such as a fourth manifold 60 and a fifth manifold 62 shown in the exemplary embodiment of FIG. 1. Each of the fourth manifold 60 and the fifth manifold 62 have at least one row of second orifices 54 spaced apart along the cross-machine direction 25. In an embodiment, the fourth manifold 60 and the fifth manifold 62 each are configured to supply a liquid, such as water, at the third pressure (that is, the pressure at third manifold 52) to the second orifices 54 to produce a columnar jet 50 at each third orifice 54. In other suitable embodiments, each of the fourth manifold 60 and the fifth manifold 62 may supply the liquid at a pressure other than the third pressure. Moreover, in some embodiments, each second orifice 54 is of circular shape with a diameter in the range of about 90 to about 150 micrometers, and each second orifice 54 is spaced apart from an adjacent second orifice 54 by a second distance 56 along the cross-machine direction 25, as with third manifold 52. In other embodiments, the fourth manifold 60 and the fifth manifold 62 each may be configured in any other fashion such as to produce jets 50 that cause the fibers of nonwoven tissue web 11 to become substantially hydroentangled.

It should be recognized that, although the embodiment shown in FIG. 1 has two pre-entangling manifolds 32, 44 and three hydroentangling manifolds 52, 60, 62, any number of additional pre-entangling manifolds and/or hydroentangling manifolds may be used. In particular, each of the forming wire 22, the transfer wire 28, and the support fabric 42 carry the nonwoven tissue web 11 in the direction of machine travel at a respective speed, and as those respective speeds are increased, additional manifolds may be necessary to impart a desired hydroentangling energy to the nonwoven web 11. It is contemplated that in some suitable embodiments, one or both the pre-entangling manifolds 32, 44 can be omitted. It is further contemplated that few than three hydroentangling manifolds 52, 60, 62 can be provided in other suitable embodiments.

Suitably, no binder (i.e., chemical binding agent) is used to supplement or otherwise increase the bonds between the fibers 14, 16 of the sheet 80. Rather, the primary bonds between the fibers 14, 16 of the sheet 80 are created through hydroentangling. It is believed that the fibrils created by fibrillating 50 percent or more (by weight) of the natural cellulose fibers 14 facilitate greater bonding between the fibers through increased hydroentanglement and thus increased strength as compared to using non-frillated natural cellulose fibers 14. As mentioned above, the regenerated cellulose fibers 16 (and any synthetic fibers if used) are not fibrillated.

In one suitable embodiment, the resulting sheet 80 has a wet cross-direction tensile strength greater than about 200 gram-force (gf) and, more preferably, greater than about 250 gf. Suitably, the sheet 80 has a wet cross-direction tensile strength between about 200 gf and 600 gf and, more preferably, between about 250 gf and about 400 gf.

In one embodiment, the sheet 80 has a wet machine-direction tensile strength is greater than the wet cross-direction tensile strength. In one suitable embodiment, for example, the wet machine-direction tensile strength is at least 25 percent greater than the wet cross-direction tensile strength. More preferably, the wet machine-direction tensile strength is at least 50 percent greater than the wet cross-direction tensile strength and, even more preferably, at least 75 percent greater. In one suitable embodiment, the wet machine-direction tensile strength is at least 100 percent greater than the wet cross-direction tensile strength. Suitably, the sheet 80 has a wet machine-direction tensile strength is greater than 250 gf, more preferably greater than about 300 gf, and even more preferably greater than 350 gf. In one suitable embodiment, the sheet 80 has a wet machine-direction tensile strength between about 250 gf and 1000 gf and, more preferably, between about 300 gf and about 800.

The apparatus 10 illustrated in FIG. 1 also may be configured to remove a desired portion of the remaining fluid, for example water, from the nonwoven tissue web 11 after the hydroentanglement process to produce a dispersible nonwoven sheet 80. In some embodiments, the hydroentangled nonwoven web 11 is transferred from the support fabric 42 to a through-drying fabric 72, which carries the nonwoven web 11 through a through-air dryer 70. In some embodiments, the through-drying fabric 72 is a coarse, highly permeable fabric. The through-air dryer 70 is configured to pass hot air through the nonwoven tissue web 11 to remove a desired amount of fluid. Thus, the through-air dryer 70 provides a relatively non-compressive method of drying the nonwoven tissue web 11 to produce the dispersible nonwoven sheet 80. In other suitable embodiments, other methods may be used as a substitute for, or in conjunction with, the through-air dryer 70 to remove a desired amount of remaining fluid from the nonwoven tissue web 11 to form the dispersible nonwoven sheet 80. Furthermore, in some suitable embodiments, the dispersible nonwoven sheet 80 may be wound on a reel (not shown) to facilitate storage and/or transport prior to further processing. The dispersible nonwoven sheet 80 may then be processed as desired, for example, infused with a wetting composition including any combination of water, emollients, surfactants, fragrances, preservatives, organic or inorganic acids, chelating agents, pH buffers, and the like, and cut, folded and packaged as a dispersible moist wipe.

Figure 7:
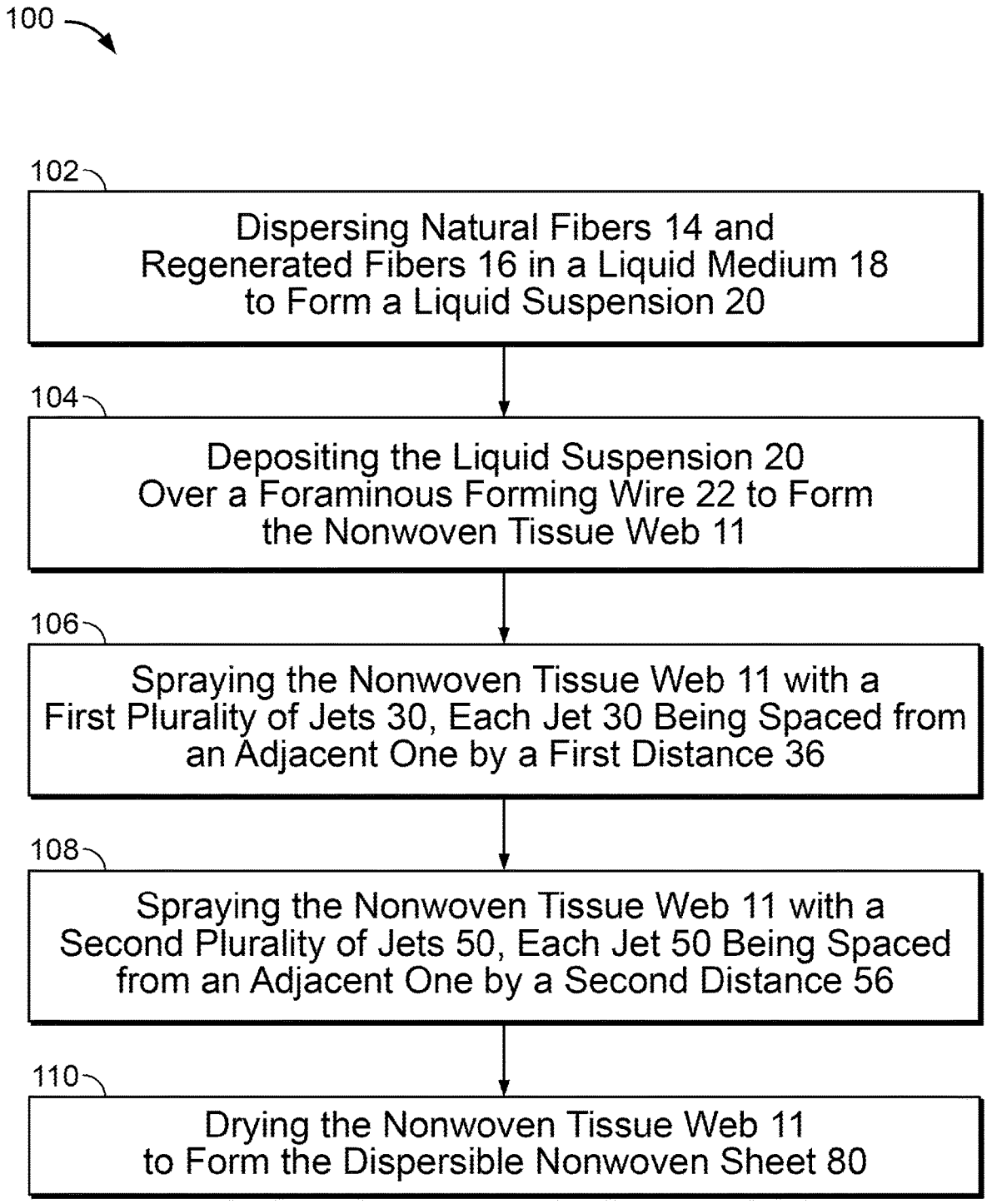
FIG. 7 is a flow chart of an embodiment of a process for making a moist dispersible wipe.

One suitable embodiment of a method 100 for making the dispersible nonwoven sheet 80 is set forth in FIG. 7. The method 100 includes dispersing 102 natural fibers 14 and regenerated fibers 16 in a ratio of about 80 to about 95 percent by weight natural fibers 14, wherein at least 50 percent of the natural cellulose fibers are fibrillated, and about 5 to about 20 percent by weight regenerated fibers 16 in the liquid medium 18 to form a liquid suspension 20. It also includes depositing 104 the liquid suspension 20 over the foraminous forming wire 22 to form the nonwoven tissue web 11. The method 100 further includes spraying 106 the nonwoven tissue web 11 with the first plurality of jets 30, each jet 30 being spaced from an adjacent one by a first distance 36. Additionally, the method 100 includes spraying 108 the nonwoven tissue web 11 with the second plurality of jets 50, each jet 50 being spaced from an adjacent one by a second distance 56, wherein the second distance 56 is less than the first distance 36. The method 100 moreover includes drying 110 the nonwoven tissue web 11 to form the dispersible nonwoven sheet 80.

Figure 4:
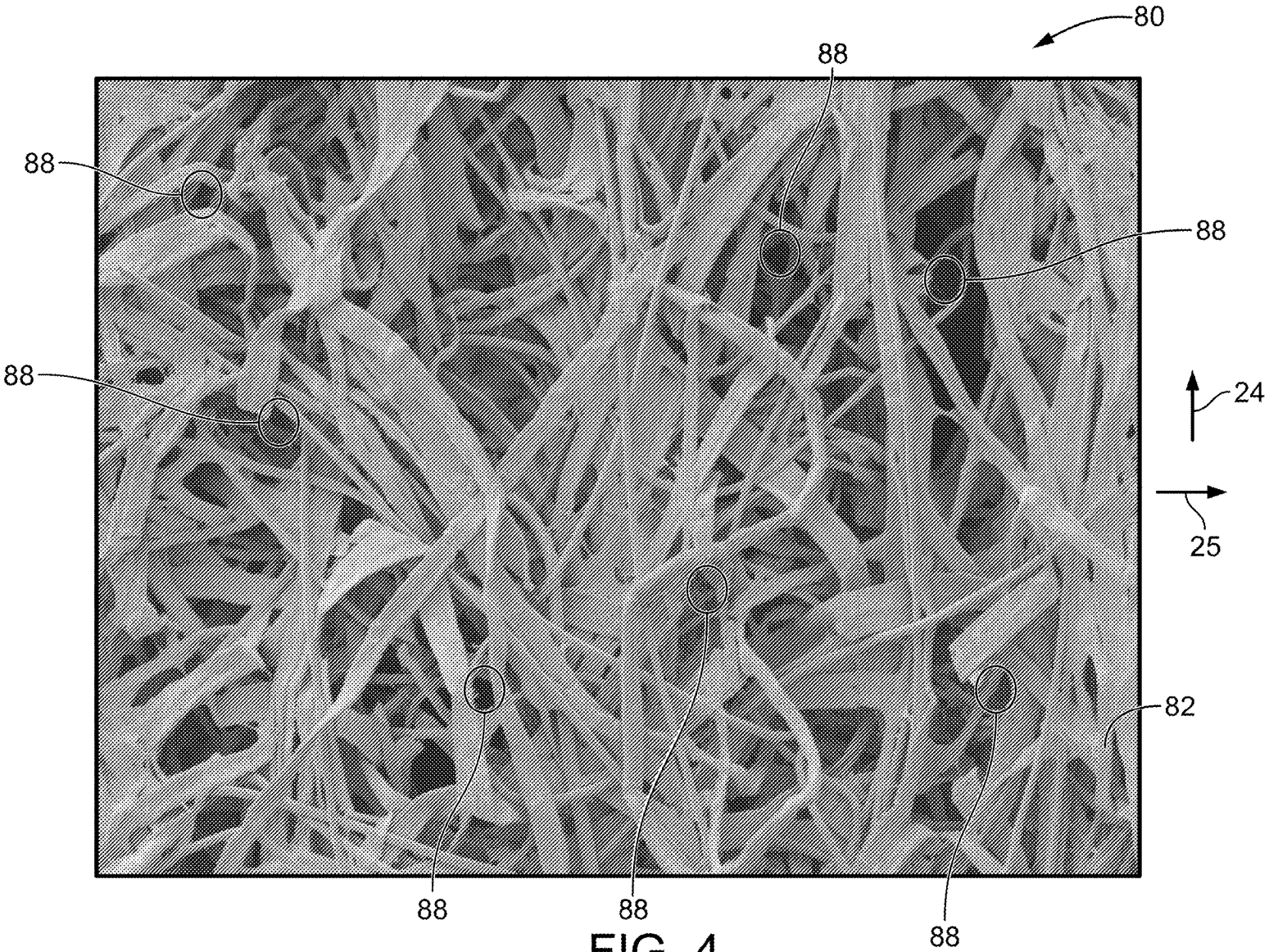
FIG. 4 is a bottom view of one suitable embodiment of a nonwoven web.
Figure 5:
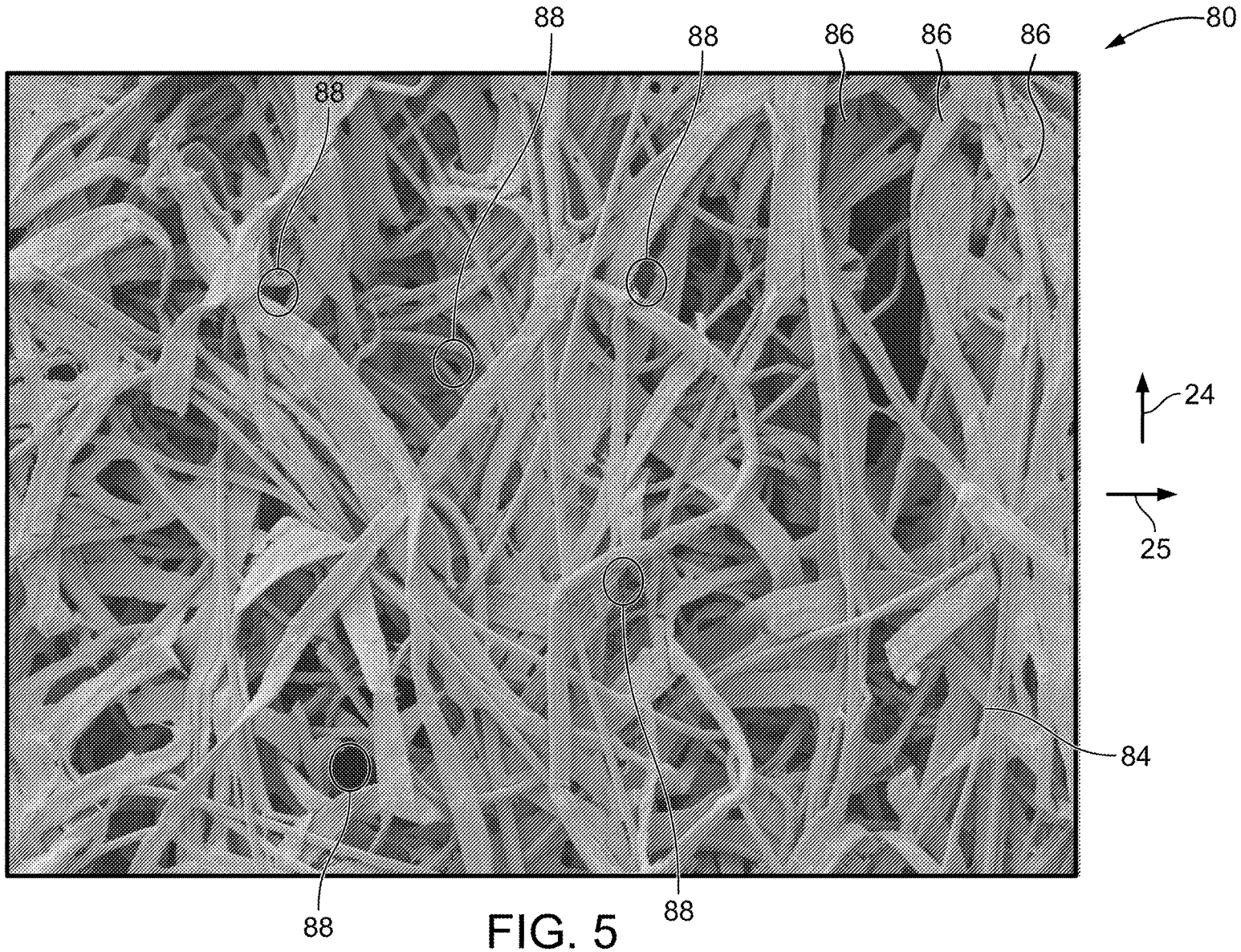
FIG. 5 is a top view of one suitable embodiment of a nonwoven web.
Figure 6:
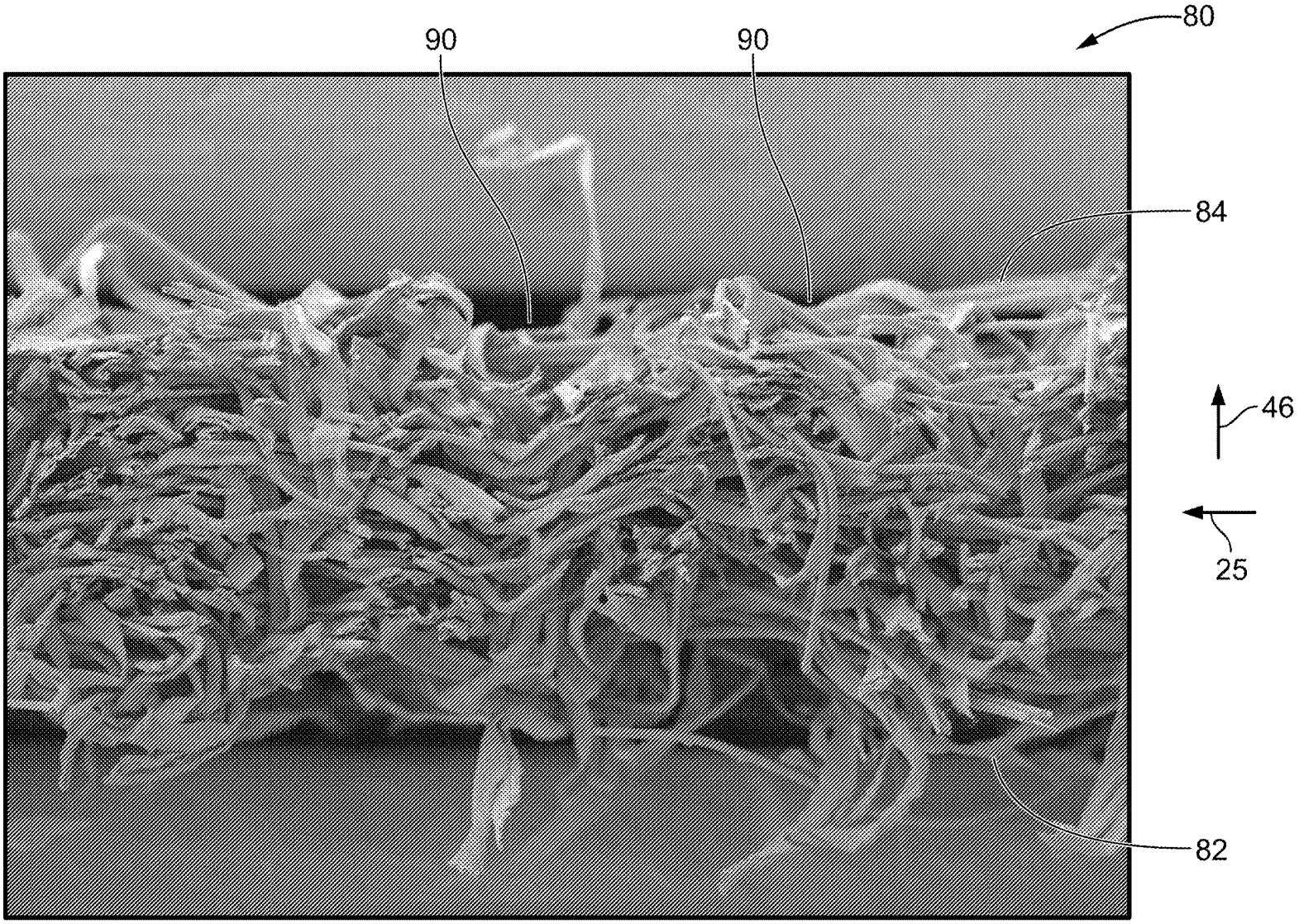
FIG. 6 is a side view of one suitable embodiment of a nonwoven web.

One suitable embodiment of the nonwoven sheet 80 made using the method described above is illustrated in FIG. 4, FIG. 5, and FIG. 6. An enlarged view of a bottom side 82, that is, the side in contact during manufacture with the forming wire 22, the transfer wire 28, and the support fabric 42, of a portion of the nonwoven sheet 80 is shown in FIG. 4. An enlarged view of a top side 84, that is, the side opposite the bottom side 82, of a portion of the nonwoven sheet 80 is shown in FIG. 5. As best seen in FIG. 5, the nonwoven sheet 80 includes ribbon-like structures 86 of relatively higher entanglement along the machine direction 24, each ribbon-like structure is spaced apart in the cross-machine direction 25 at a distance approximately equal to the second distance 56 between second orifices 54 of the second plurality of jets 50. In addition, at some locations between the ribbon-like structures 86, holes 88 are visible, as seen in FIG. 4 and FIG. 5. The holes 88 often are more pronounced in the bottom surface 82 due to the high-impact of the jets 30 and 50 against the transfer wire 28 adjacent the bottom surface 82 during the hydroentangling process. As visible in a side view of a portion of the nonwoven sheet 80 in FIG. 6, certain areas 90 of the nonwoven sheet 80 display less fiber entanglement through a thickness of the sheet 80, and more displacement in the direction 46 perpendicular to the plane of the sheet 80. The more pronounced areas 90 may appear as holes 88 when viewed from the top or bottom.

EXAMPLES

A plurality of discreet, individual dispersible nonwoven sheets 80 (i.e., individual moist wipes) was prepared as described below. For all of the sheets, northern softwood kraft was selected as the natural fibers 14 and TENCEL® brand lyocell with a fineness of about 1.7 deniers was selected as the regenerated fibers 16. The nominal length of the regenerated fibers 16 used in each sample sheet is set forth below in Table 1. Specifically, samples were created using regenerated fibers 16 having a nominal length of 6 mm and 12 mm.

The percent total by weight of regenerated fibers and natural fibers used to form each of the sample sheets is also set forth in Table 1. As seen in Table 1, the regenerated fibers 16 made up either 5 percent or 10 percent by weight of each of the sample sheets, and the natural cellulose fibers made up the remaining 90 percent or 95 percent by weight of the sample sheet. Of the natural cellulose fibers, samples were made wherein none of the natural cellulose fibers were fibrillated (i.e., 0 percent by weight), fifty percent of the natural cellulose fibers were fibrillated (i.e., 50 percent by weight); and all of the natural cellulose fibers were fibrillated (i.e., 100 percent by weight).

The nominal basis weight of the sample sheets ranged from about 62 grams per meter squared to about 69 grams per meter squared. The nominal basis weight of each of the sample sheets is set forth in Table 1.

For all of the examples, the first plurality of jets 30 was provided by first and second manifolds and the second plurality of jets 50 was provided by third, fourth and fifth manifolds. The support fabric rate of travel was 30 meters per minute. The first manifold had 120 micrometer orifices spaced 1800 micrometers apart in the cross-machine direction, and the second, third, fourth and fifth manifolds each had 90 micrometer orifices spaced 600 micrometers apart in the cross-machine direction. The first, second, third, fourth and fifth manifolds each operated at the same pressure for a given sample, and that pressure is set forth in Table 1. Specifically, the pressure was set at either 20, 40, 60, 80, or 100 bar for each of the manifolds.

TABLE 1

| Sample No. | Regenerated Fiber Length (mm) | Percent by Weight Regenerated Fibers | Percent by Weight Natural Cellulose Fibers | Percent by Weight of Natural Cellulose Fibers Fibrillated | HET Pressure (Bar) | Basis Weight (gsm) | Wet CD Tensile (gf) | Wet MD Tensile (gf) | Burst WET ZD Peak Load [gf] | Time to 1st Break (min) | Time to 1" pieces (min) |
|---|---|---|---|---|---|---|---|---|---|---|---|
| 1 | 12 | 10% | 90% | 100% | 20 | 67.7701 | 258.32 | 346.9 | 611.76 | 7 | 24 |
| 2 | 12 | 10% | 90% | 0% | 40 | 64.8423 | 262.86 | 452.08 | 699.06 | 11 | 51 |
| 3 | 12 | 10% | 90% | 100% | 40 | 66.8552 | 359.3 | 426.9 | 856.26 | 16 | 74 |
| 4 | 12 | 10% | 90% | 0% | 60 | 61.69 | 323 | 560 | NA | 52 | >180 |
| 5 | 12 | 10% | 90% | 100% | 60 | 66.7906 | 476.04 | 577.34 | 1112.64 | 24 | 180 |
| 6 | 6 | 10% | 90% | 100% | 20 | 66.9844 | 177.4 | 288.88 | 317 | 5 | 29 |
| 7 | 6 | 5% | 95% | 0% | 40 | 64.9392 | 126.4 | 280.84 | 273 | 5 | 21 |
| 8 | 6 | 5% | 95% | 100% | 40 | 67.2858 | 214.98 | 317.76 | 328 | 6 | 31 |
| 9 | 6 | 10% | 90% | 0% | 40 | 63.26 | 135.22 | 373.1 | 366 | 2 | 24 |
| 10 | 6 | 10% | 90% | 50% | 40 | 63.9705 | 170.5 | 333.7 | 416 | 3 | 36 |
| 11 | 6 | 10% | 90% | 100% | 40 | 68.825 | 213.32 | 446.82 | 512 | 8 | 75 |
| 12 | 6 | 5% | 95% | 0% | 60 | 63.6475 | 155.68 | 290.6 | 287 | 6 | 44 |
| 13 | 6 | 5% | 95% | 100% | 60 | 67.1028 | 225.56 | 344.64 | 413 | 22 | 112 |
| 14 | 6 | 10% | 90% | 0% | 60 | 63.5076 | 163.5 | 359.12 | 508 | 16 | 63 |
| 15 | 6 | 10% | 90% | 50% | 60 | 63.6152 | 223.92 | 412.38 | 531 | 14 | 82 |
| 16 | 6 | 10% | 90% | 100% | 60 | 66.909 | 237.86 | 492.68 | 655 | 23 | >180 |
| 17 | 6 | 5% | 95% | 0% | 80 | 65.9295 | 157.92 | 391.32 | 360 | 13 | 97 |
| 18 | 6 | 5% | 95% | 100% | 80 | 67.3934 | 216.92 | 412.76 | 500 | 42 | >180 |
| 19 | 6 | 5% | 95% | 0% | 100 | 66.3924 | 148.6 | 431.74 | 400 | 27 | >180 |
| 20 | 6 | 5% | 95% | 100% | 100 | 68.642 | 205.88 | 493.82 | 602 | 54 | >180 |

The strength of the dispersible nonwoven sheets 80 generated from each example was evaluated by measuring the wet tensile strength in the machine direction; the wet tensile strength in the cross-machine direction; and the wet burst strength. Tensile strength was measured using a Constant Rate of Elongation (CRE) tensile tester having a 1-inch jaw width (sample width), a test span of 3 inches (gauge length), and a rate of jaw separation of 25.4 centimeters per minute after soaking the sheet in tap water for 4 minutes and then draining the sheet on dry Viva® brand paper towel for 20 seconds. This drainage procedure resulted in a moisture content of 200 percent of the dry weight +/−50 percent. This was verified by weighing the sample before each test. One-inch wide strips were cut from the center of each of the sample sheets in the specified machine direction ("MD") or cross-machine direction ("CD") orientation using a JDC Precision Sample Cutter (Thwing-Albert Instrument Company, Philadelphia, Pa., Model No. JDC3-10, Serial No. 37333). The "MD tensile strength" is the peak load in grams-force per inch of sample width when a sample is pulled to rupture in the machine direction. The "CD tensile strength" is the peak load in grams-force per inch of sample width when a sample is pulled to rupture in the cross direction.

The wet burst strength was determined by using the tensile tester to measure the force necessary to cause the sample to burst or tear. The sample being tested was secured and suspended horizontally. A foot of the tester descended onto the sample until it tore. The tester recorded the peak load required to tear the sample. The tensile tester was equipped with a computerized data-acquisition system that is capable of calculating peak load and energy between two predetermined distances (15-60 millimeters). The foot of the tester is aluminum and has a length of 4.5 inches, a diameter of 0.50 inch, and a radius of curvature at the end of 0.25 inch.

The instrument used for measuring the wet tensile strength and the wet burst strength of each sample was an MTS Systems Sinergie 200 model and the data acquisition software was MTS TestWorks® for Windows Ver. 4.0 commercially available from MTS Systems Corp., Eden Prairie, Minn. The load cell was an MTS 50 Newton maximum load cell. For the wet tensile strength, the gauge length between jaws was 4±0.04 inches and the top and bottom jaws were operated using pneumatic-action with maximum 60 P.S.I. The break sensitivity was set at 70 percent. The data acquisition rate was set at 100 Hz (i.e., 100 samples per second). The sample was placed in the jaws of the instrument, centered both vertically and horizontally. The test was then started and ended when the force drops by 70 percent of peak. The peak load was expressed in grams-force and was recorded as the "MD tensile strength" or the "CD tensile strength" of the specimen. For the wet burst strength, the foot was lowered onto the sample at a rate of 16 inches per minute until the sample tears. The peak load (gram force) is the wet burst strength for the sample.

The dispersibility of each of the samples was measured using the slosh box test equipment described for INDA/EDANA method FG502 The Slosh Box Test uses a bench-scaled apparatus to evaluate the potential for breakup or dispersibility of flushable consumer products as they travel through the wastewater collection system. In this test, a clear plastic tank was loaded with a product and tap water. The container was then rocked back and forth by a cam system at a specified rotational speed to simulate the movement of wastewater in the collection system. The initial breakup point and the time for dispersion of the product into pieces measuring 1 inch by 1 inch (25 mm by 25 mm) were recorded in the laboratory notebook. This 1 inch by 1 inch (25 mm by 25 mm) size is a parameter that is used because it reduces the potential of product recognition.

Four (4) liters of 21° C. tap water was placed in the plastic container/tank. A timer was set for three hours and cycle speed was set for 15 rpm. The time to first breakup and full dispersion to 1" pieces were recorded in a laboratory notebook. Photographs were also taken of samples at first break and 1" pieces end points.

The test was terminated when the product reached a dispersion point of no piece larger than 1 inch by 1 inch (25 mm by 25 mm) square or reached 3 hours (180 minutes) whichever came first.

The results of the Wet CD Tensile Strength, Wet MD Tensile Strength, Wet Burst Strength and Slosh Box dispersibility tests are reported in Table 1. As provided therein, the hydroentanglement pressure, percent by weight of regenerated fibers, the length of the regenerated fibers, the percent by weight of natural cellulose fibers, and the percent by weight of the natural cellulose fibers that fibrillated all contribute to the strength and dispersibility of the sample. It was discovered that the dispersible nonwoven sheets within the scope of this disclosure, which were created at relatively low pressures and thus relatively low hydroentangling energies, exhibited unexpectedly good combinations of strength and dispersibility. More specifically, samples 1, 3, 8, 11, 13, and 15 are within the scope of this invention.

For example, Samples 1 and 3, which were formed with 10 percent by weight regenerated fibers have a length of approximately 12 mm and 90 percent by natural, fibrillated cellulose fibers (100 percent of the natural cellulose fibers were fibrillated), demonstrated good combinations of strength and dispersibility. Sample 1 was formed using 20 bars of pressure whereas Sample 3 was formed using 40 bars of pressure. With respect to strength, Samples 1 and 3 exhibited Wet CD Tensile Strengths of approximately 260 gf and 360 gf, respectively, and Wet MD Tensile Strengths of approximately 350 gf and 430 gf, respectively. The Burst Strength of Samples 1 and 3 was approximately 610 gf and 860 gf, respectively. Thus, the strength of both Samples 1 and 3 is clearly within acceptable ranges to withstand the forces placed on the sheet during use. With respect to dispersibility, Samples 1 and 3 dispersed into pieces less than 1 inch in less than 24 minutes and 74 minutes, respectively, in the slosh box. Accordingly, both of these Samples exhibited acceptable dispersibility.

Sample 5, which was formed with 10 percent by weight regenerated fibers have a length of approximately 12 mm and 90 percent by natural, fibrillated cellulose fibers (100 percent of the natural cellulose fibers were fibrillated) at 60 bars, demonstrated good strength but unacceptable dispersibility. With respect to dispersibility, Sample 5 dispersed into pieces less than 1 inch in about 180 minutes in the slosh box. For purposes of this application, dispersibility is acceptable if the slosh box results are less than 180 minutes for the sample disperse into pieces less than 1 inch and, more preferably, less than 90 minutes, and even more preferably, less than 60 minutes. As can be readily appreciated, the faster the samples disperses into pieces less than 1 inch, the better.

Sample 6, which was formed with 10 percent by weight regenerated fibers have a length of approximately 6 mm and 90 percent by natural, fibrillated cellulose fibers (100 percent of the natural cellulose fibers were fibrillated) at 20 bars, demonstrated good dispersibility but unacceptable strength. For example, with respect to strength, Sample 6 exhibited a Wet CD Tensile Strength of about 180 gf, which is believed to be too low to withstand the forces exerted on the sheet during use.

Samples 8 and 13, which were formed with 5 percent by weight regenerated fibers have a length of approximately 6 mm and 95 percent by natural, fibrillated cellulose fibers (100 percent of the natural cellulose fibers were fibrillated), demonstrated good combinations of strength and dispersibility. Sample 8 was formed using 40 bars of pressure whereas Sample 13 was formed using 60 bars of pressure. With respect to strength, Samples 8 and 13 exhibited Wet CD Tensile Strengths of approximately 215 gf and 225 gf, respectively, and Wet MD Tensile Strengths of approximately 320 gf and 345 gf, respectively. The Burst Strength of Samples 8 and 13 was approximately 330 gf and 410 gf, respectively. Thus, the strength of both Samples 8 and 13 is clearly within acceptable ranges to withstand the forces placed on the sheet during use. With respect to dispersibility, Samples 8 and 13 dispersed into pieces less than 1 inch in less than 31 minutes and 112 minutes, respectively, in the slosh box. Accordingly, both of these Samples exhibited acceptable dispersibility.

Sample 10, which was formed with 10 percent by weight regenerated fibers have a length of approximately 6 mm and 90 percent by natural cellulose fibers wherein half (i.e., 50 percent) of the natural cellulose fibers were fibrillated at 40 bars, demonstrated good dispersibility but unacceptable strength. For example, with respect to strength, Sample 10 exhibited a Wet CD Tensile Strength of about 170 gf, which is believed to be too low to withstand the forces exerted on the sheet during use.

Sample 11, which was formed with 10 percent by weight regenerated fibers have a length of approximately 6 mm and 90 percent by natural, fibrillated cellulose fibers (100 percent of the natural cellulose fibers were fibrillated), demonstrated good combinations of strength and dispersibility. Sample 11 was formed using 40 bars of pressure. With respect to strength, Sample 11 exhibited a Wet CD Tensile Strength of approximately 210 gf and a Wet MD Tensile Strength of approximately 450 gf. The Burst Strength of Sample 11 was approximately 510 gf. Thus, the strength of Sample 11 is clearly within acceptable ranges to withstand the forces placed on the sheet during use. With respect to dispersibility, Sample 11 dispersed into pieces less than 1 inch in less than 75 minutes in the slosh box. Accordingly, Sample 11 exhibited acceptable dispersibility.

Sample 15, which was formed with 10 percent by weight regenerated fibers have a length of approximately 6 mm and 90 percent by natural cellulose fibers wherein half (i.e., 50 percent) of the natural cellulose fibers were fibrillated, demonstrated good combinations of strength and dispersibility. Sample 15 was formed using 60 bars of pressure. With respect to strength, Sample 15 exhibited a Wet CD Tensile Strengths of approximately 225 gf and a Wet MD Tensile Strength of approximately 410 gf. The Burst Strength of Sample 15 was approximately 530 gf. Thus, the strength of Sample 15 is clearly within acceptable ranges to withstand the forces placed on the sheet during use. With respect to dispersibility, Sample 15 dispersed into pieces less than 1 inch in less than 82 minutes in the slosh box. Accordingly, Sample 15 exhibited acceptable dispersibility.

Sample 16, which was formed with 10 percent by weight regenerated fibers have a length of approximately 6 mm and 90 percent by natural, fibrillated cellulose fibers (100 percent of the natural cellulose fibers were fibrillated) at 60 bars, demonstrated good strength but unacceptable dispersibility. With respect to dispersibility, it took more than 180 minutes for Sample 16 to disperse into pieces less than 1 inch in the slosh box.

Samples 18 and 20, which was formed with 5 percent by weight regenerated fibers have a length of approximately 6 mm and 95 percent by natural, fibrillated cellulose fibers (100 percent of the natural cellulose fibers were fibrillated) at 80 bars and 100 bars, respectively, demonstrated good strength but unacceptable dispersibility. With respect to dispersibility, it took more than 180 minutes for Samples 18 and 20 to disperse into pieces less than 1 inch in the slosh box.

Accordingly, the flushable moist wipes of the present disclosure have an in-use strength sufficient to withstand a user's extraction of the wipe from a dispenser and the user's wiping activity, but then relatively quickly lose strength to enhance compatibility with household and municipal sanitization systems, such as sewer or septic systems. Because the strength of the disclosed wipes is achieved without the use of a net or bonded thermoplastics, the dispersibility of the wipes remains relatively high. In addition, by using 90 to 95 percent natural cellulose fibers and only 5 to about 10 percent of the more expensive regenerated fibers, the cost associated with manufacturing the wipe is significantly reduced. Additional costs savings is realized during the manufacturing process by not using any binder (e.g., a triggerable salt-sensitive binder).

In the interests of brevity and conciseness, any ranges of values set forth in this disclosure contemplate all values within the range and are to be construed as support for claims reciting any sub-ranges having endpoints which are whole number values within the specified range in question. By way of hypothetical example, a disclosure of a range of from 1 to 5 shall be considered to support claims to any of the following ranges: 1 to 5; 1 to 4; 1 to 3; 1 to 2; 2 to 5; 2 to 4; 2 to 3; 3 to 5; 3 to 4; and 4 to 5.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispersible moist wipe comprising regenerated cellulose fibers in an amount equal to or less than 20 percent by weight and natural cellulose fibers in an amount equal to or greater than 80 percent by weight, at least 60 percent of the natural cellulose fibers being fibrillated, the regenerated cellulose fibers and the natural cellulose fibers being hydroentangled into a web such that the web has a wet CD tensile strength of at least 200 grams per inch.

2. The dispersible moist wipe set forth in claim 1 wherein the regenerated cellulose fibers is in an amount equal to or less than 10 percent by weight and the natural cellulose fibers is in an amount equal to or greater than 90 percent by weight.

3. The dispersible moist wipe set forth in claim 1 wherein 100 percent of the natural cellulose fibers are fibrillated.

4. The dispersible moist wipe set forth in claim 1 wherein the web comprises between 5 and 10 percent by weight regenerated cellulose fibers and between 90 and 95 percent natural cellulose fibers.

5. The dispersible moist wipe set forth in claim 1 wherein the web has a wet CD tensile strength of at least 250 grams per inch.

6. The dispersible moist wipe set forth in claim 5 wherein the web has a wet CD tensile strength of at least 300 grams per inch.

7. The dispersible moist wipe set forth in claim 1 wherein the natural cellulose fibers are softwood pulp.

8. The dispersible moist wipe set forth in claim 1 wherein the regenerated cellulose fibers have a length in the range of about 4 millimeters to about 15 millimeters.

9. The dispersible moist wipe set forth in claim 8 wherein the regenerated cellulose fibers have a length in the range of about 6 millimeters to about 12 millimeters.

10. The dispersible moist wipe set forth in claim 1 wherein the regenerated cellulose fibers have decitex between 0.7 g/10,000 m and 2 g/10,000 m.

11. The dispersible moist wipe set claim 10 wherein the regenerated cellulose fibers have decitex between 0.9 g/10,000 m and 1.1 g/10,000 m.

* * * * *